US006578718B2

(12) United States Patent
Levy

(10) Patent No.: US 6,578,718 B2
(45) Date of Patent: Jun. 17, 2003

(54) PAINT CHIP DISPLAY SYSTEM

(76) Inventor: Raymond H. Levy, 976 Rector Rd., Bridgewater, NJ (US) 08807

( * ) Notice: Subject to any disclaimer, the term of this patent is extended or adjusted under 35 U.S.C. 154(b) by 0 days.

(21) Appl. No.: 09/845,628

(22) Filed: Apr. 30, 2001

(65) Prior Publication Data

US 2002/0030026 A1 Mar. 14, 2002

Related U.S. Application Data

(60) Provisional application No. 60/200,798, filed on May 1, 2000.

(51) Int. Cl.[7] ..... B42F 1/00

(52) U.S. Cl. ..... 211/50; 211/86.01

(58) Field of Search ..... 211/50–52, 55, 211/48, 40, 81, 88.01, 94.01, 71.01, 168, 96, 126.2, 128.1, 86.01; 40/124, 124.2; 312/50, 61

(56) References Cited

U.S. PATENT DOCUMENTS 3,280,822 A * 10/1966 Pipe ..... 211/51
3,760,952 A * 9/1973 White ..... 211/168
4,069,941 A * 1/1978 Popplewell, Jr. et al. ... 206/215
4,532,727 A * 8/1985 Klose et al. ..... 40/152
4,569,448 A * 2/1986 Graham ..... 211/89
4,805,331 A * 2/1989 Boggess et al. ..... 40/651
5,470,138 A * 11/1995 Kump ..... 206/39.5
5,495,953 A * 3/1996 Bearth ..... 211/40
5,603,415 A * 2/1997 Balnis, Jr. ..... 211/40
5,769,244 A * 6/1998 Wyatt ..... 211/40
5,894,931 A * 4/1999 Dunn ..... 206/555
5,984,441 A * 11/1999 Stokhuijzen ..... 211/96
6,006,927 A * 12/1999 Levy ..... 211/51
6,156,275 A * 12/2000 Dumitrescu et al. ..... 211/71.01
6,213,313 B1 * 4/2001 Levy ..... 211/51
6,279,761 B1 * 8/2001 Niewiadomski et al. . 211/94.01

* cited by examiner

*Primary Examiner*—Daniel P. Stodola
*Assistant Examiner*—Jennifer E. Novosad
(74) *Attorney, Agent, or Firm*—Duane Morris LLP

(57) ABSTRACT

A paint chip display system including a plurality of containers each having a partially open front face. Each of the containers includes: a rear-wall portion having a front surface and a back surface, the rear wall portion being substantially oppositely disposed from the open front face; a first side-wall portion disposed between the rear wall portion and the open front face; a second side-wall portion disposed between the rear wall portion and the open front face, the rear wall portion and first and second side wall portions define a cavity, and, a front wall portion secured to at least one of the first and second side-wall portion and partially obscuring the open front face. The first side-wall portion includes at least one mounting protrusion, and the second side-wall portion includes at least one corresponding slot, and the mounting protrusion and slot are positioned such that when the mounting protrusion of a first of the containers is engaged with the slot of a second of the containers, the rear-wall portion of one of the first or second containers is substantially adjacent to the open front face of the other of the first and second containers. The interlocked containers further are removably secured to a mounting bracket by at least one mounting protrusion extending from the real wall portion.

10 Claims, 5 Drawing Sheets

PAINT CHIP DISPLAY SYSTEM

This application claims priority from U.S. Provisional Application serial No. 60/200,798, filed on May 1, 2000, the entire disclosure of which is hereby incorporated by reference.

FIELD OF INVENTION

The invention relates to display structures and more particularly to paint chip display structures.

BACKGROUND OF INVENTION

In the marketing of paint it is desirable to provide paint chips to prospective paint customers demonstrating colors and surface finishes corresponding to the effects obtained by using the different colors and types of paint being marketed. Such paint chips can be typically characterized as small pieces of heavy paper or cardboard having a finish on a front surface corresponding to at least one paint finish and color intended to be represented. Display of such paint chips typically involves the use of suitable stands or display devices permitting a prospective paint customer to select one or more paint chips representative of paints and colors he wishes to purchase.

It is desirable to display such paint chips in close proximity to each other and in a stacked manner to allow a prospective paint purchaser to easily view and concurrently compare different colors and finishes of the paints. Further it is desirable to allow the prospective paint purchaser to remove a paint chip and reveal another paint chip representative of the same paint and color as represented by the removed paint chip.

One disadvantage of typical paint chip display devices is the ability of the customer to remove the last paint chip of a select color and finish, necessitating the supply of paint chips to be replenished before another prospective customer can view a similar paint chip sample corresponding to the exhausted supply. Accordingly, it is desirable to develop a low cost, display system that allows for the simultaneous display of a paint sample corresponding to each stack of paint chips representative of a paint and color that is non removable and adequately protected from attempted removal by a prospective paint customer. Furthermore, it is desirable to reduce the required floor space of the display by eliminating extensive cabinetry and surface area by allowing the paint chip display to be easily modified to include space for only those paint chips desired to be displayed. It is further desirable to provide a paint chip display device with a relatively low cost and ease of assembly of the device itself

SUMMARY OF THE INVENTION

A paint chip display device that includes a plurality of containers each of which has a partially open front face, a rear-wall portion having a front surface and a back surface, the rear wall portion being substantially oppositely disposed from the open front face; a first side-wall portion disposed between the rear wall portion and the open front face, a second side-wall portion disposed between the rear wall portion and the open front face, the rear wall portion and first and second side wall portions at least partially defining a cavity, and a front wall portion secured to at least one of the first and second side-wall portion and partially obscuring the open front face. The first side-wall portion includes at least one mounting protrusion, and the second side-wall portion includes at least one corresponding slot, and the mounting protrusion and slot are positioned such that when said mounting protrusion of a first of the containers is engaged with the slot of a second of the containers, the rear-wall portion of one of the first or second containers is substantially adjacent to the open front face of the other of said first and second containers.

Figure 1:
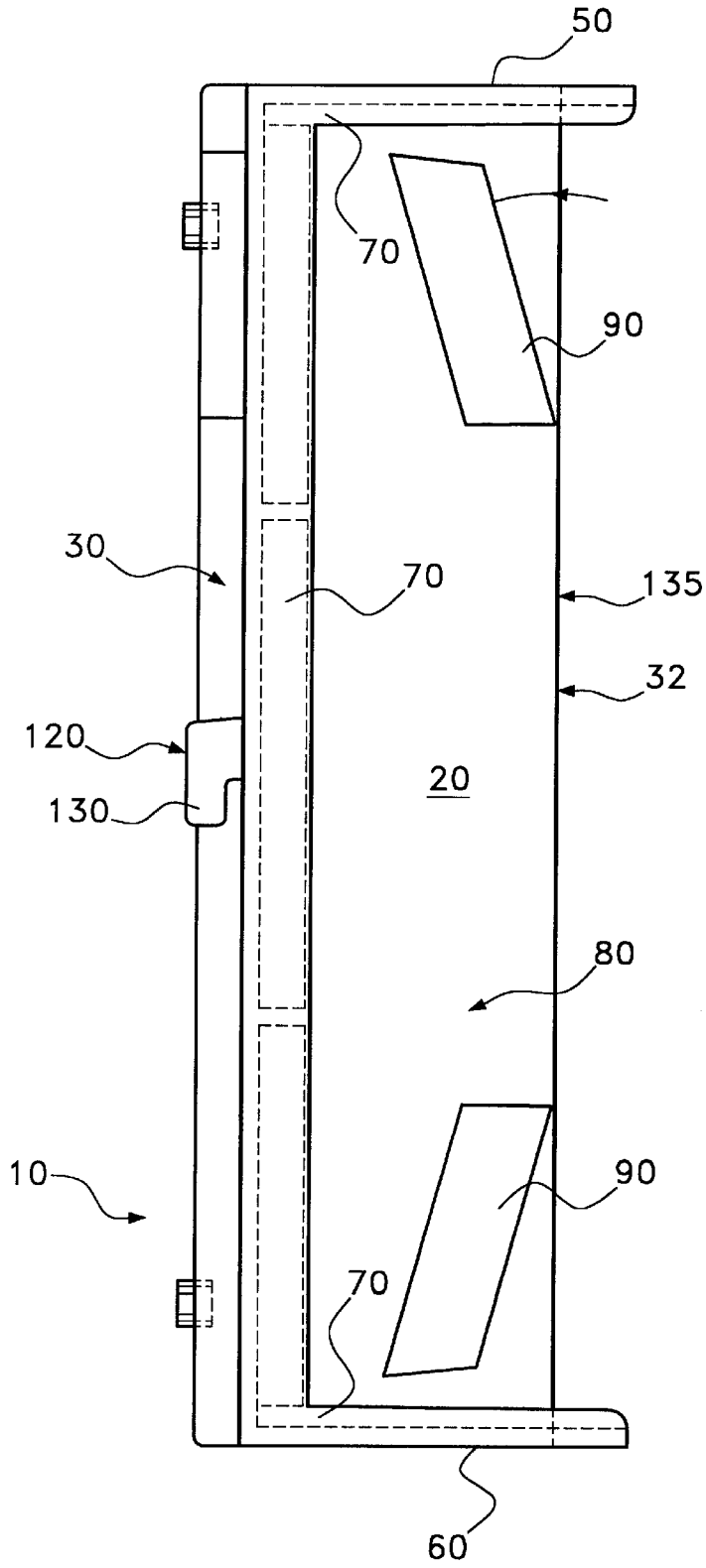
FIG. 1 is a front view of a display pocket according to the present invention.

It is to be understood that these drawings are solely for purposes of illustrating the concepts of the invention and are not intended as a level of the limits of the invention. It will be appreciated that the same reference numerals, possibly supplemented with reference characters where appropriate, have been used throughout to identify corresponding parts.

DETAILED DESCRIPTION OF THE INVENTION

Commonly assigned U.S. Pat. No. 6,212,312 B1 issued Apr. 10, 2001 to Levy, describes a paint chip display system wherein paint chip display pockets are stacked in an overlapping manner. The present invention relates to a paint chip display system comprised of a plurality of paint chip display pockets and extrusions for securing the pockets to a surface. Each pocket is capable of displaying a plurality of like stacked paint chips corresponding to at least one color and finish of a paint color or finish intended to be represented.

In a preferred embodiment of the present invention, each pocket of said plurality can be coupled to any other pocket of said plurality. Each pocket is mountable onto an extrusion that may be secured to any substantially smooth surface using any suitable means, such as adhesives or screws for example. In this way, the pockets ares capable of being displayed in a side-to-side step fashion, with no modification to each pocket being necessary. More particularly, referring to the figures, wherein like references refer to like parts throughout the several figures, FIG. 1 illustrates a front view of a preferred embodiment of a paint chip display pocket 10 according to the present invention.

Referring to FIG. 1, pocket 10 according to the present invention comprises a rear wall 20, side-wall 30 and partial side-wall 32 oppositely disposed from side-wall 30, oppositely disposed top and bottom walls 50 and 60, and retention wall 70 forming a paint chip cavity 80. Cavity 80 is of suitable size for holding a plurality of paint chips in a front-to-back stacked manner. Preferably, the cavity 80 is of suitable dimensions to hold approximately 50 paint chips.

Figure 2:
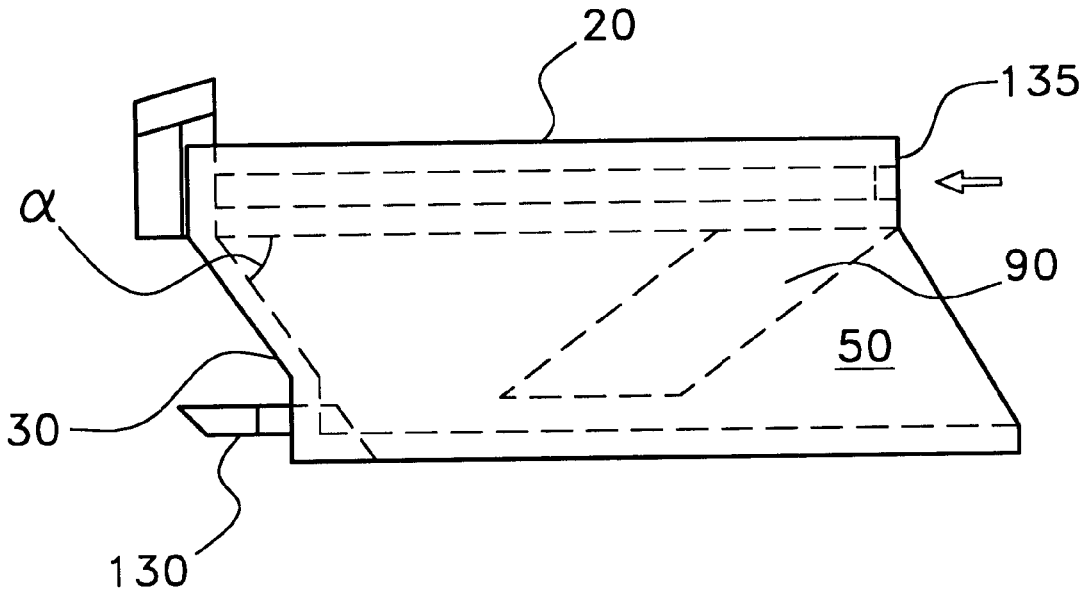
FIG. 2 is a top view of the pocket illustrated in FIG. 1.

Referring now to FIG. 2, side-wall 30 is preferably tapered towards partial side-wall 35 as it approaches retention wall 70, in order to facilitate easy removal of paint chips contained within cavity 80. The stack of paint chips are set in a cascaded or offset relationship with one another. More particularly, side-wall 30 preferably forms an angle (a) with rear-wall 20, such that the angle $\alpha$ is acute.

In one embodiment the paint chip display pocket 10 is substantially clear or transparent. In a particularly preferred embodiment the paint chip display pocket 10 is made of clear thermoformed, extruded or molded plastic resins.

Biasing means 90 is for biasing paint chips contained within the cavity 80 away from the rear wall 20, and toward retention portion 70 which partially obstructs open front face 40 which is oppositely disposed from rear-wall 20, to facilitate their easy removal by a potential paint customer. In a preferred embodiment, biasing means 90 comprises at least one biasing tab protruding from rear-wall 20 and partially protrudes into cavity 80.

Figure 4:
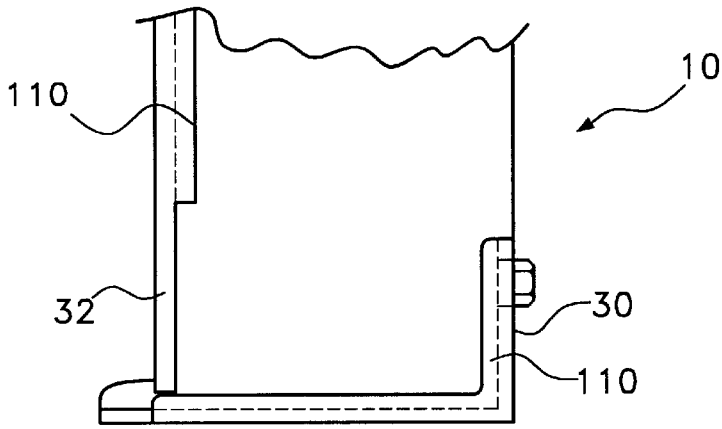
FIG. 4 is a partial rear view of the pocket illustrated in FIGS. 1, 2 and 3.

Referring now to FIG. 4, the backside of rear wall 20 includes sample retaining portions 110. Sample retaining portion 110 retains at least one "permanent" paint chip representative of the paint chips contained within the cavity 80 behind rear wall 20. Retaining at least one "permanent" paint chip behind the rear wall 20 prevents potential paint customers from attempting to remove the last paint chip of a given color and finish, thereby ensuring future potential paint customers will be able to view the representative paint chip even before the supply has been replenished.

In the embodiment illustrated in FIGS. 1–4, the sample retention portions 110 are adjacent the top and bottom walls 50, 60 and side-wall 30. However, any configuration which adequately secures at least one paint chip representative of those to be contained within the cavity 80 to the back of rear wall 20 will suffice.

Returning to the embodiment illustrated in FIG. 1, side-wall 30 and partial side-wall 32 include interlocking means 120 on outer surfaces, oppositely disposed from cavity 80. Interlocking means 120 are provide means for coupling paint chip display pocket 10 to other like paint chip display pockets. The interlocking means 120 on side-wall 30 of each paint chip display pocket 10 according to the present invention are identical in form. Similarly, the interlocking means 120 on an outer surface of partial side-wall 32 of each paint chip display pockets 10 according to the present invention are identical in form. Further, the interlocking means 120 of side-wall 30 is the mate of interlocking means 120 of partial side-wall 32. This allows a paint chip display pocket 10 to be coupled to any other like paint chip display pocket in a side-to-side fashion, with the interlocking means 120 of side-wall 30 of paint chip display pocket 10 coupling to interlocking means 120 of partial side-wall 32 of any other paint chip display pocket according to the present invention.

More particularly, the interlocking means 120 on side-wall 30 comprises at least one L-shaped protrusion 130, and preferably two, formed so as to extend from side-wall 30 substantially adjacent to open front face 40, e.g. opposite from rear wall 20. Further, the interlocking means 120 on partial side-wall 32 comprises a slot 135 formed in partial side-wall 32 substantially adjacent to rear-wall 20. In this manner when the L-shaped protrusion 130 of a first pocket 10 is engaged with slot 135 of a second pocket 10, the two pockets are coupled in a stepped relationship such that the full-faces of paint chips contained are displayed.

Figure 3:
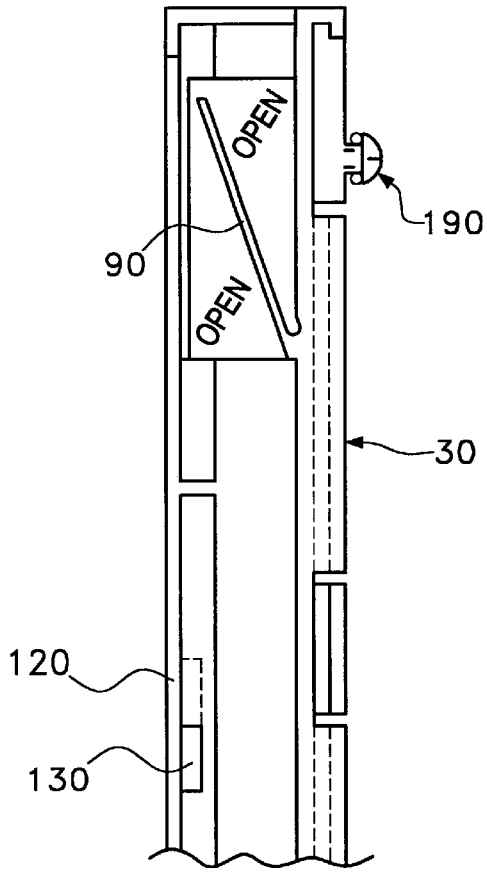
FIG. 3 is a partial side view of the pocket illustrated in FIGS. 1 and 2.
Figure 5:
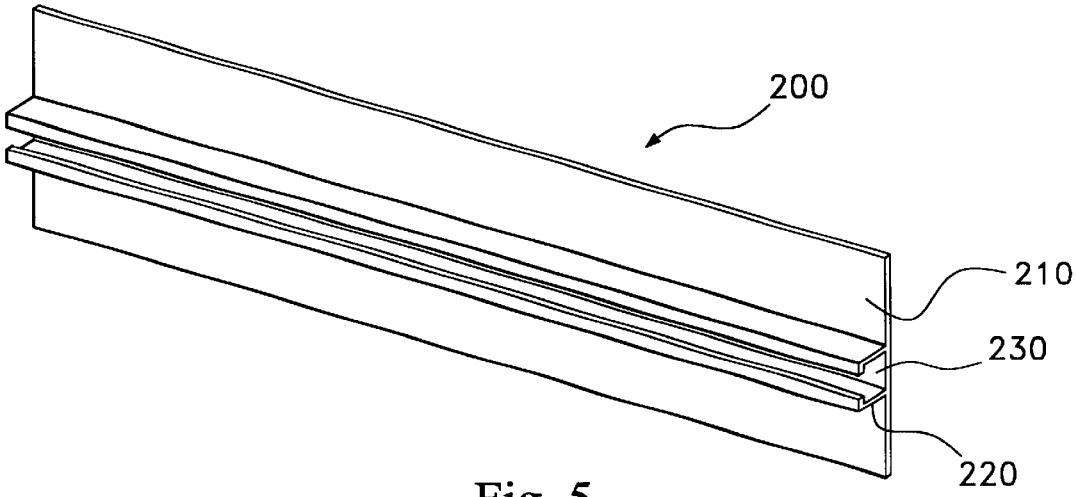
FIG. 5 is a perspective view of a mounting board suitable for use with the display pocket illustrated in FIGS. 1–4.
Figure 6:
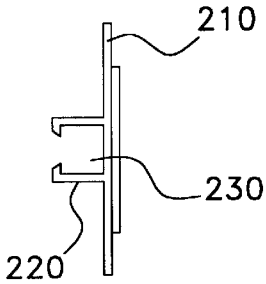
FIG. 6 is a diagram of the mounting board illustrated in FIG. 5.

Referring now to FIG. 3, mounting protrusions 190 protrude from rear wall to couple each pocket 10 to a mounting board 200. Referring now also to FIG. 5, therein is illustrated a preferred form of mounting board 200.

Mounting board 200 includes curved wall portion 220 secured to, and preferably integratedly formed with, planar backplane portion 210. Bracket 200 is preferably extruded plastic. The curved wall portion 220 forms a recess 230 adapted to receive and secure mounting portions 190 of a pocket or container 10 such that an arrowhead-like tip portion of each portion 190 is secured within recess 230 by the curved wall portion 220. Preferably at least one lip formed by the arrowhead-like tip protrusion 190 is secured against at least one lip formed by the curved wall portion 220 at the outermost ends of the curved wall portion 220. Each backplane portion 210 can be secured to a wall or other device using conventional means such as adhesives, nails, screws, staples or any other suitable means for coupling. Alternatively, the backplane 210 could be part of a display stand.

Thus, according to a preferred form of the present invention each pocket, or container, 10 is coupled to backplane 200 using protrusions 190 and curved wall portion 220, and to at least one other pocket, or container, 10 using L-shaped protrusion, or tab, 130 or slot 135.

Figure 7:
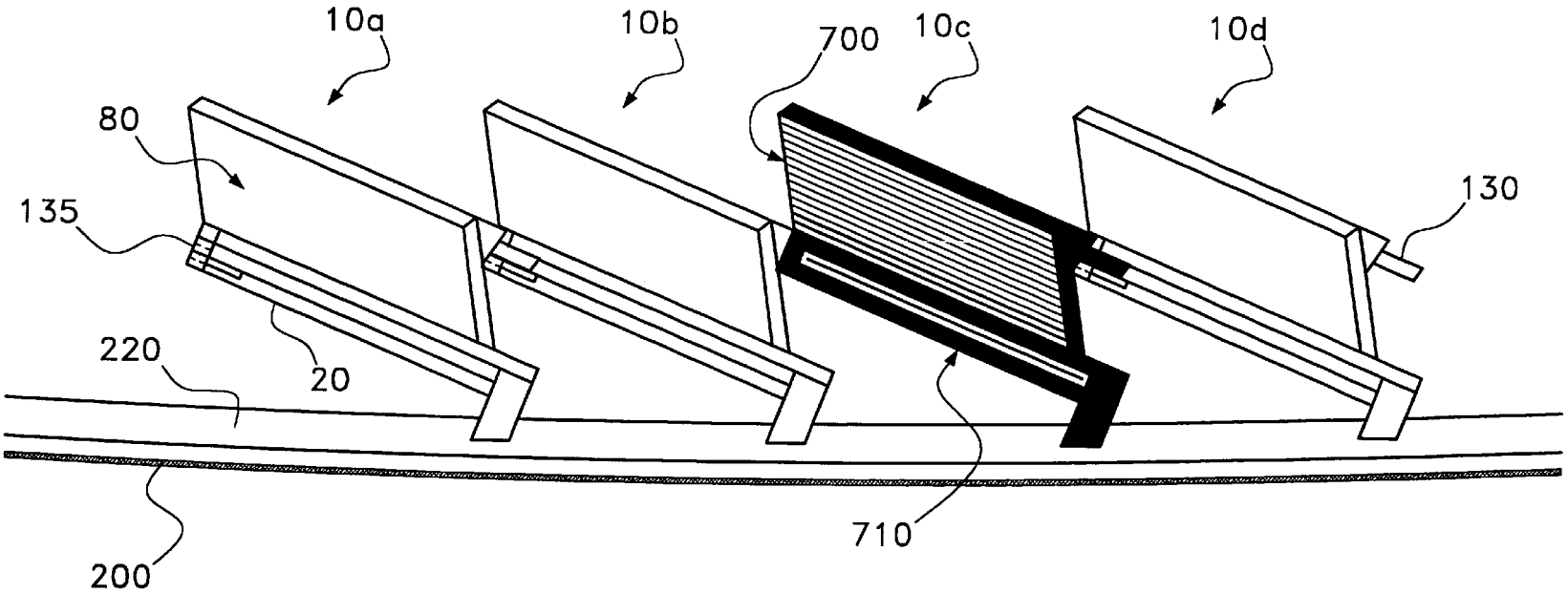
FIG. 7 is a top view of the containers illustrated in FIGS. 1–4 coupled to the mounting board illustrated in FIGS. 5 and 6.

FIG. 7 illustrates a top view of multiple containers 10 coupled to one another and together coupled to backplane 200 according to a preferred form of the present invention such that they do not significantly overlap, but are in a stepped-configuration. In this preferred from, interlocking means 130 is shown engaging interlocking means 135. Further, in this illustrative example, a plurality of paint chips 700 are shown in a step-wise configuration in cavity 80 of pocket 10*c*. Paint chips are in a step-wise configuration as side wall 30 tapers toward partial side wall 32. Also illustrated is permanent paint chip 710, which is located in a separate area within display pocket 10*c*. Permanent paint chip 710 is representative of the color and finish on each of the illustrated plurality of paint chips 710 stored in a corresponding display pocket.

Although the invention has been described in a preferred form with a certain degree of particularity, it is understood that the present disclosure of the preferred form has been made only by way of example, and that numerous changes in the details of construction and combination and arrangement of parts may be made without departing from the spirit and scope of the invention as hereinafter claimed. It is intended that the patent shall cover by suitable expression in the appended claims, whatever features of patentable novelty exist in the invention disclosed.

I claim:

1. An open front face paint chip display holder device defining a container, said device comprising:

a rear-wall portion having a front surface and back surface, said rear wall portion being substantially oppositely disposed from an open front face of said container;

a first side-wall portion disposed between said rear wall portion and said open front face of said container, said first side wall portion including at least one mounting protrusion;

a second side-wall portion disposed between said rear wall portion and said open front face, said first side-wall portion is tapered toward said second side-wall portion, said second side-wall portion including at least one slot substantially opposite and offset from a corresponding one of said at least one mounting protrusion wherein said slot is closer to said rear wall than said corresponding mounting protrusion, said rear wall portion and said first and second side wall portions at least partially defining a cavity therebetween; and, a front wall portion secured to at least one of said first and second side-wall portions and at least partially obscuring said open front face.

2. The device as recited in claim 1 wherein said first side-wall portion forms an acute angle with said front surface of said rear-wall portion.

3. The device as recited in claim 1 further comprising:

at least one biasing means attached to said front surface of said rear-wall portion.

4. The device as recited in claim 3 wherein said biasing means includes a first end and a second end, wherein said first end is fixedly attached to said rear-wall portion and said second end extends toward said open front face.

5. The device as recited in claim 1 further comprising:

at least one retaining tab on each of said first side-wall portion and said second side-wall portion, said at least one retaining tab substantially oppositely disposed from said back surface of said rear wall.

6. The device as recited in claim 5 further comprising:

at least one securing lip on said at least one mounting protrusion.

7. A paint chip display system for displaying a plurality of paint chip samples comprising:

a plurality of paint chip containers, joined in a stepped configuration, each of said paint chip containers having a rear-wall, a first side-wall, a second side-wall, a substantially open front face, and at least one lipped mounting protrusion extending from said rear-wall, at least one mounting protrusion on said first side-wall, at least one corresponding slot on said second side-wall positioned substantially opposite and offset from a corresponding one of said at least one mounting protrusion wherein said slot is closer to said rear wall than said corresponding mounting protrusion, biasing means having a first end fixedly attached to said rear-wall and a second end directed toward said substantially open front face to bias said plurality of paint chip samples toward said substantially open front face;

at least one mounting board each having at least one engaging means operable to receive corresponding said container lipped mounting protrusions, wherein said plurality of containers are removably secured to said at least one mounting board.

8. The system as recited in claim 7 wherein each of said container first side-walls is tapered toward said second side-wall such that when said container engages said mounting board said first side-wall is substantially perpendicular to said mounting board.

9. The system as recited in claim 8 wherein said lipped mounting protrusions are substantially parallel to said first side-wall.

10. An open front face paint chip display holder device defining a container, said device comprising:

a rear-wall portion having a front surface and back surface, said rear wall portion being substantially oppositely disposed from an open front face of said container;

a first side-wall portion disposed between said rear wall portion and said open front face of said container;

at least one mounting protrusion disposed on said first side-wall portion;

a second side-wall portion disposed between said rear wall portion and said open front face, said rear wall portion and said first and second side wall portions at least partially defining a cavity therebetween, said first side-wall portion forming an acute angle with said rear-wall front face;

a slot disposed in said second side-wall portion substantially opposite and offset from a corresponding one of said at least one mounting protrusions, wherein said slot is closer to said rear wall than said corresponding mounting protrusion; and, a front wall portion secured to at least one of said first and second side-wall portions and at least partially obscuring said open front face.

* * * * *